US006427764B2

(12) United States Patent
Nash

(10) Patent No.: US 6,427,764 B2
(45) Date of Patent: Aug. 6, 2002

(54) HEAT EXCHANGER HAVING SELECTIVELY COMPLIANT END SHEET

(75) Inventor: James S. Nash, West Newbury, MA (US)

(73) Assignee: Ingersoll-Rand Energy Systems Corporation, Portsmouth, NH (US)

( * ) Notice: Subject to any disclaimer, the term of this patent is extended or adjusted under 35 U.S.C. 154(b) by 0 days.

(21) Appl. No.: 09/904,788

(22) Filed: Jul. 13, 2001

Related U.S. Application Data

(60) Provisional application No. 60/010,998, filed on Feb. 1, 1996.

(51) Int. Cl.[7] ..... F28D 1/03; F28F 3/12

(52) U.S. Cl. ..... 165/82; 165/149; 165/153; 165/167

(58) Field of Search ..... 165/153, 166, 165/167, 170, 149, 81, 82, 906

(56) References Cited

U.S. PATENT DOCUMENTS 3,166,122 A * 1/1965 Hryniszak ..... 165/166
3,322,189 A * 5/1967 Topouzian ..... 165/166
4,073,340 A * 2/1978 Parker ..... 165/166
4,291,754 A * 9/1981 Morse et al. ..... 165/167
5,720,341 A * 2/1998 Watanabe et al. ..... 165/153

* cited by examiner

*Primary Examiner*—Leonard Leo
(74) *Attorney, Agent, or Firm*—Michael Best & Friedrich LLP

(57) ABSTRACT

A heat exchanger includes a core adapted to heat air with counter-flowing hot gases. Substantially isothermal hot and cool portions of the core are interconnected by a matrix portion exposed to a temperature gradient. A top sheet is positioned over the core and includes first and second ends and a middle portion between the first and second ends. The middle portion includes a window and compliant ligament portions extending alongside the window and interconnecting the first and second ends. The first and second ends of the top sheet are positioned over the isothermal cool and hot portions of the core, respectively, and the middle portion of the top sheet is positioned over the matrix portion of the core. The compliant ligament portions of the top sheet are deflectable in response to the temperature gradient across the matrix portion of the core to reduce strain on and deflection of the first and second ends of the top sheet.

8 Claims, 4 Drawing Sheets

HEAT EXCHANGER HAVING SELECTIVELY COMPLIANT END SHEET

Attention is directed to related U.S. patent application Ser. No. 09/790,464 filed Feb. 22, 2001, which is a continuation-in-part of U.S. patent application Ser. No. 09/668,358 filed Sep. 25, 2000 abandoned, which is a continuation-in-part of U.S. patent application Ser. No. 09/409,641 filed Oct. 1, 1999 now U.S. Pat. No. 6,305,079, which is a continuation of U.S. patent application Ser. No. 09/239,647 filed Jan, 29, 1999 now U.S. Pat. No. 5,983,992, which is a continuation of U.S. patent application Ser. No. 08/792,261 filed Jan. 13, 1997, which claims the benefit of U.S. Provisional Application No. 60/010,998 filed Feb. 1, 1996.

BACKGROUND

The invention relates to recuperators primarily for use in gas turbine engines, and more particularly to an end sheet construction for the cores of such recuperators.

SUMMARY

The present invention provides a heat exchanger comprising a core including a stacked array of plate-fin cells and a top sheet positioned over the core.

The core is adapted to heat air flowing through the cells with hot gases flowing in-between the cells, and includes a substantially isothermal cool portion into which the flow of air enters the cells and out of which the flow of hot gases exits the core from in-between the cells, a substantially isothermal hot portion into which the flow of hot gases enters the core in-between the cells and out of which the flow of air exits the cells, and a matrix portion in-between the substantially isothermal hot and cool portions.

The air and hot gases flow in counterflow relationship to each other through the matrix portion. The majority of heat transfer between the flows of air and hot gases occurs within the matrix portion, and a temperature gradient is therefore established across the matrix portion.

The top sheet includes first and second ends and a middle portion between the first and second ends. The middle portion includes a window and compliant ligament portions extending alongside the window and interconnecting the first and second ends. The first and second ends of the top sheet are positioned over the isothermal cool and hot portions of the core, respectively, and the middle portion of the top sheet is positioned over the matrix portion of the core. The compliant ligament portions of the top sheet are deflectable in response to the temperature gradient across the matrix portion of the core to reduce strain on and deflection of the first and second ends of the top sheet.

Other features and advantages of the invention will become apparent to those skilled in the art upon review of the following detailed description, claims, and drawings.

Figure 1:
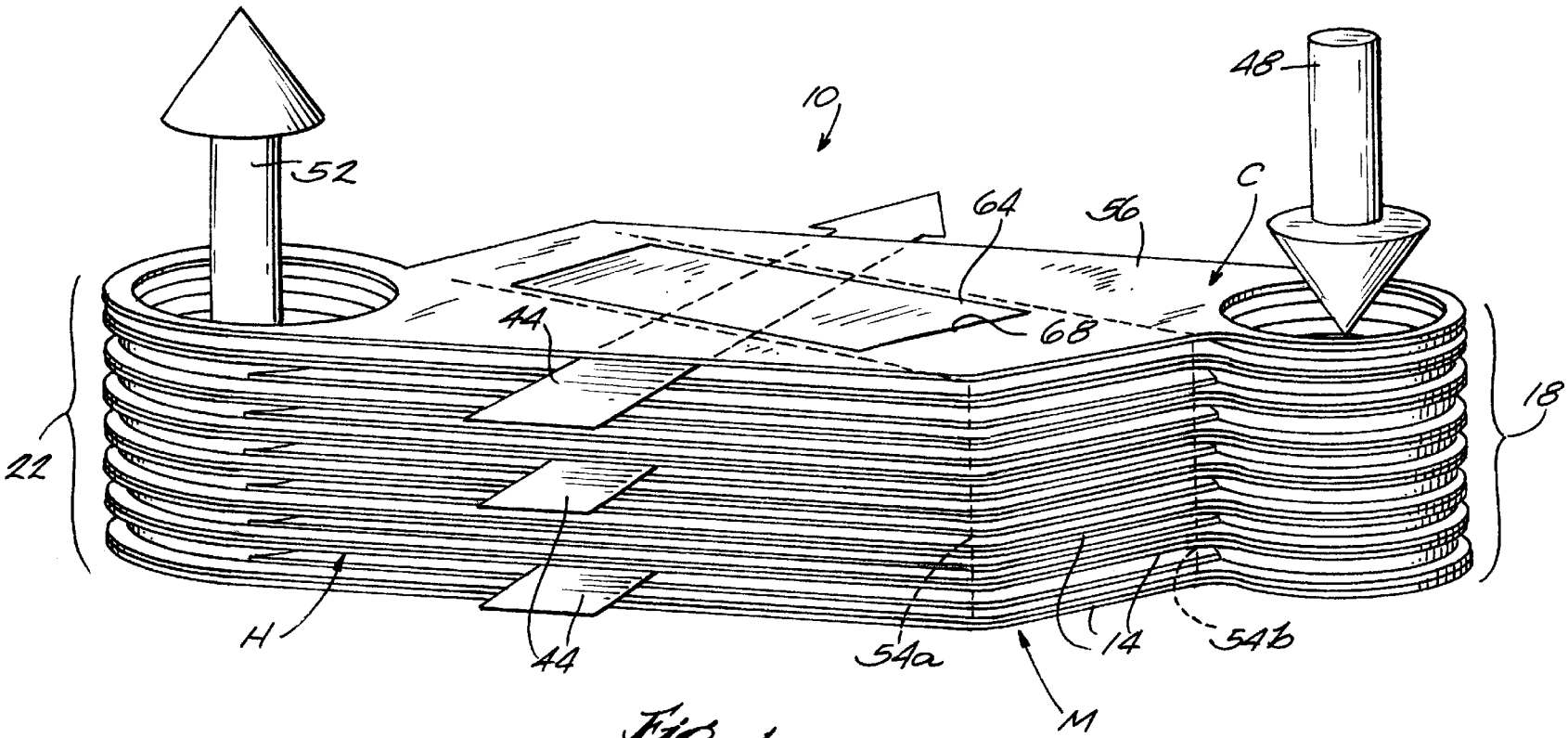
FIG. 1 is a perspective view of the core of a recuperator.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Plate fin heat exchangers used in microturbine combustors are discussed in U.S. patent application Ser. Nos. 09/790,464 filed Feb. 22, 2001, 09/668,358 filed Sep. 25, 2000, 09/409,641 filed Oct. 1, 1999, 09/239,647 filed Jan. 29, 1999 (now U.S. Pat. No. 5,983,992), and 08/792,261 filed Jan. 13, 1997, and U.S. Provisional Patent Application No. 60/010,998 filed Feb. 1, 1996, all assigned to the assignee of the present invention. The entire contents of each of these patent applications are incorporated herein by reference.

Figure 2:
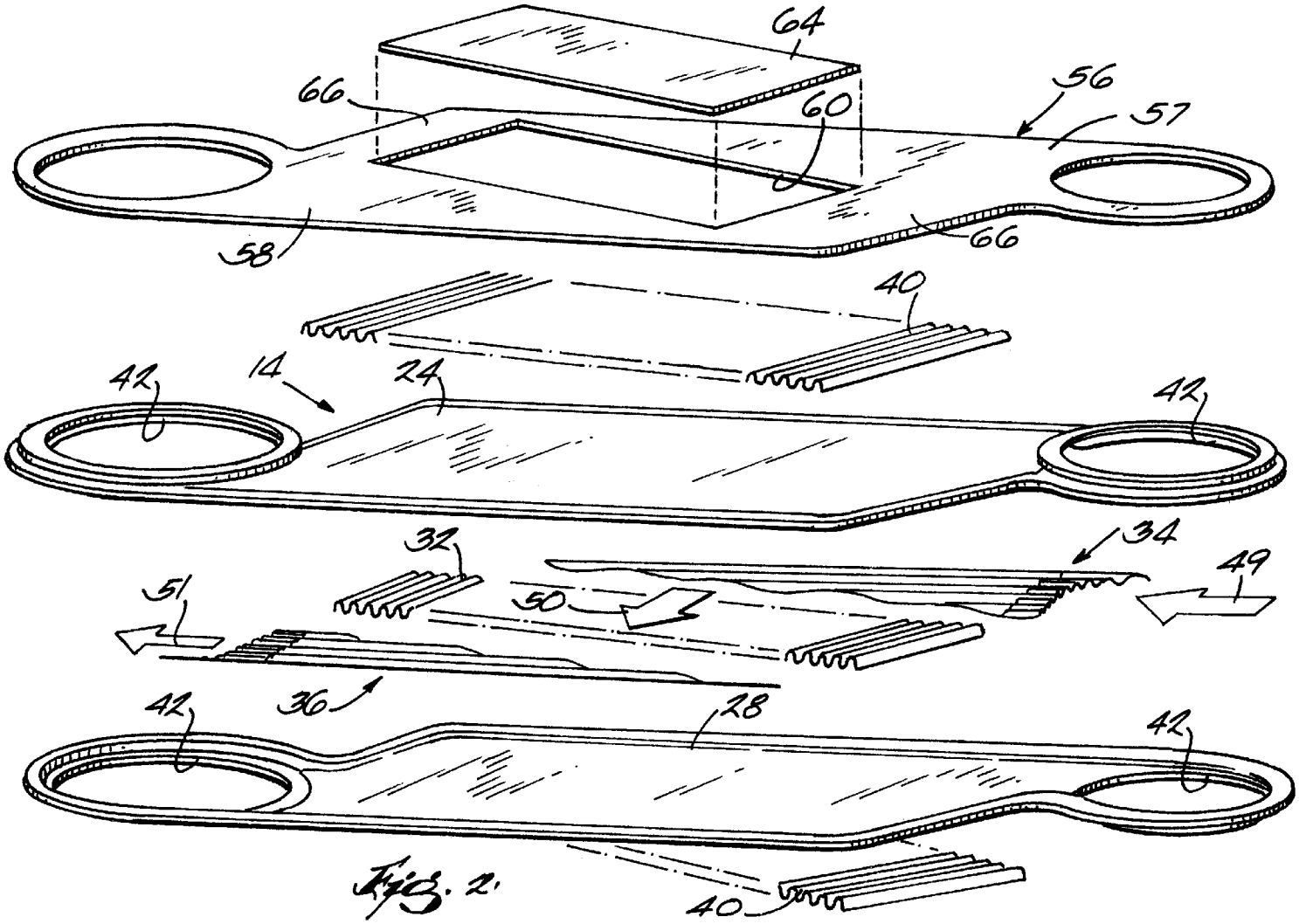
FIG. 2 is an exploded view of the top cell and end sheet of the core illustrated in FIG. 1.
Figure 3:
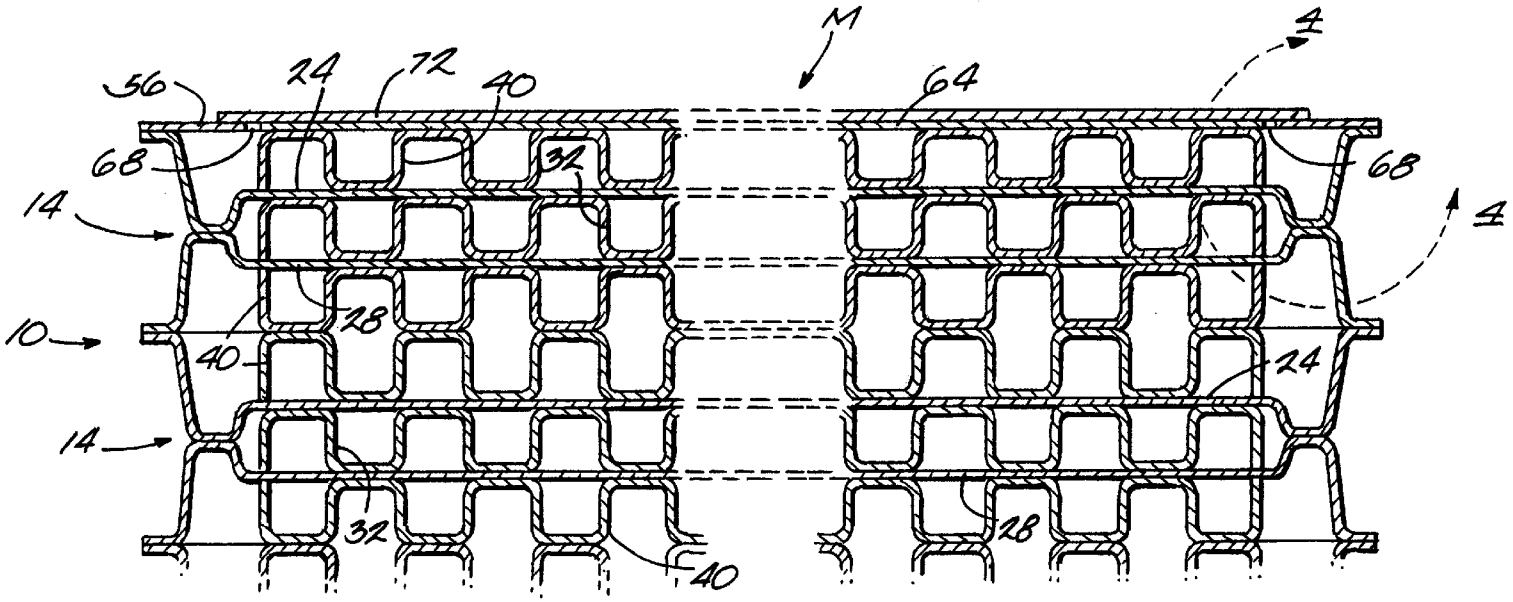
FIG. 3 is a cross-sectional side view of the core of FIG. 1.
Figure 4:
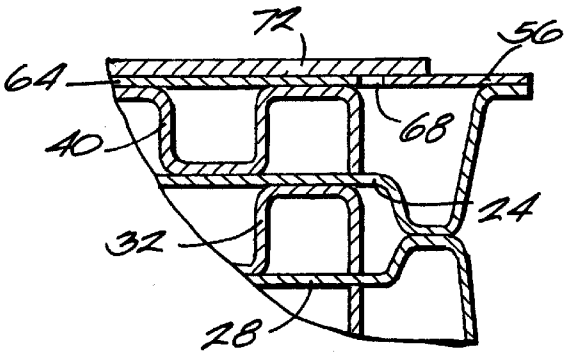
FIG. 4 is an enlarged view of the portion of FIG. 3 encircled by line 4—4.
Figure 5:
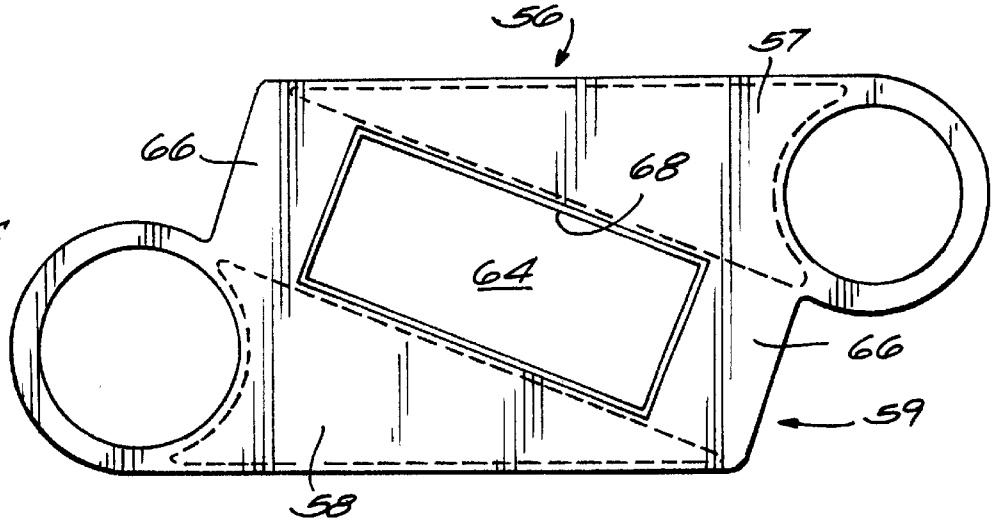
FIG. 5 is a plan view of the top sheet of the core illustrated in FIG. 1.

FIG. 1 illustrates a core 10 for a recuperator used in a microturbine. The core 10 includes a plurality of stacked plate-fin cells 14 defining an inlet manifold 18 and an outlet manifold 22. As seen in FIG. 2, each cell 14 includes top and bottom plates or sheets 24, 28, an internal or matrix finned member 32, inlet and outlet header finned members 34, 36 respectively, and external finned members 40. The top and bottom plates 24, 28 define manifold openings 42 that align to define the manifolds 18, 22. The manifold openings 42 are circular and the manifolds 18, 22 are cylindrical in the illustrated embodiment, but could have other configurations.

Products of combustion or hot gases from the microturbine's combustor pass through the external finned members 40 between the cells 14 as illustrated at 44 in FIG. 1. At the same time, compressed air flows into the inlet manifold 18 as shown at 48, From the inlet manifold 18, the compressed air enters the cells 14 over the inlet header finned members 34 in the direction indicated at 49 in FIG. 2. The compressed air then turns about 90° and flows in the direction indicated at 50 in FIG. 2 as it passes over the matrix finned members 32. The direction 50 is substantially opposite the direction 44. Then the compressed air turns about 90° again and flows out of the cells 14 over the outlet header finned members 36 in the direction 51 in FIG. 2. Finally, the compressed air flows out of the core through the outlet manifold 22 as shown at 52 in FIG. 1.

As seen in FIG. 1, due to the counterflow of the hot products of combustion over the external finned members 40 and the compressed air over the matrix finned members 32, the core 10 is characterized by a substantially isothermal and relatively cool portion C around the inlet manifold 18 and above and below the inlet header finned members 34. The flow of air enters the core 10 and the spent products of combustion exit the core 10 through the substantially isothermal cool portion C. The core 10 is also characterized by a substantially isothermal and relatively hot portion H around the outlet manifold 22 and above and below the outlet header finned members 36. The hot products of combustion enter the core 10 and the heated flow of air exits the core 10 through the substantially isothermal hot portion H. A matrix portion M (defined generally between the broken lines 54*a* and 54*b* in FIG. 1) of the core 10, is disposed between the hot and cool portions H, C of the core 10 and above and below the external finned members 40 and matrix finned members 32. Most of the heat transfer between the air and products of combustion takes place in the matrix portion M of the core 10.

A hot fluid flow region is defined between the cells 14 and along the external finned members 40, and a cool fluid flow region is defined within the cells 14 and along the matrix finned members 32. As described above, hot products of combustion and relatively cool compressed air flow in opposite directions 44, 50 in the respective hot and cool fluid flow regions, heat transfer occurs in the matrix portion M of the core 10, and a temperature gradient is therefore established across the matrix portion M.

As seen in FIGS. 1-4, an end sheet or top sheet 56 is provided on top of the core 10. The uppermost hot fluid flow region is defined between the top sheet 56 and the cell 14 at the top of the core 10. The top sheet 56 includes first and second ends 57, 58, positioned over the substantially isothermal cool and hot portions C, H, respectively, and a middle portion 59 disposed between the first and second ends 57, 58. A window 60 (FIG. 2) is cut into the middle portion 59 of the top sheet 56. A matrix cover 64, which is preferably the portion of the top sheet 56 cut out when the window 60 is created, is positioned within the window 60. Compliant strips or ligament portions 66 therefore run alongside the window 60 and interconnect the first and second ends 57, 58 of the top sheet 56. The window 60 is positioned directly over the top external finned member 40. The window 60 is slightly smaller in at least one dimension (e.g., length and/or width) than the external finned member 40 so that the external finned member 40 does not extend through the window 60.

As seen in FIGS. 1 and 3–5, a kerf 68 is created during formation of the window 60 and surrounds the matrix cover 64. The window 60 is preferably created with a laser cutting process, and the kerf 68 is therefore preferably about 0.03 inches wide. The kerf 68 illustrated in the drawings is greatly exaggerated for the purposes of illustration and is not drawn to scale.

A top frame plate 72 is positioned over the top sheet 56 and covers the kerf 68 to minimize leakage of products of combustion through the kerf 68. The top frame plate 72 is preferably fixed to a frame surrounding the core 10 such that the top frame plate 72 restricts vertical expansion of the core 10 during thermal cycles. Alternatively, the top frame plate 72 may be resiliently biased down onto the top sheet 56 by springs or other biasing members such that vertical thermal expansion of the core 10 is permitted while the top frame plate 72 is held firmly against the top sheet 56.

Figure 6:
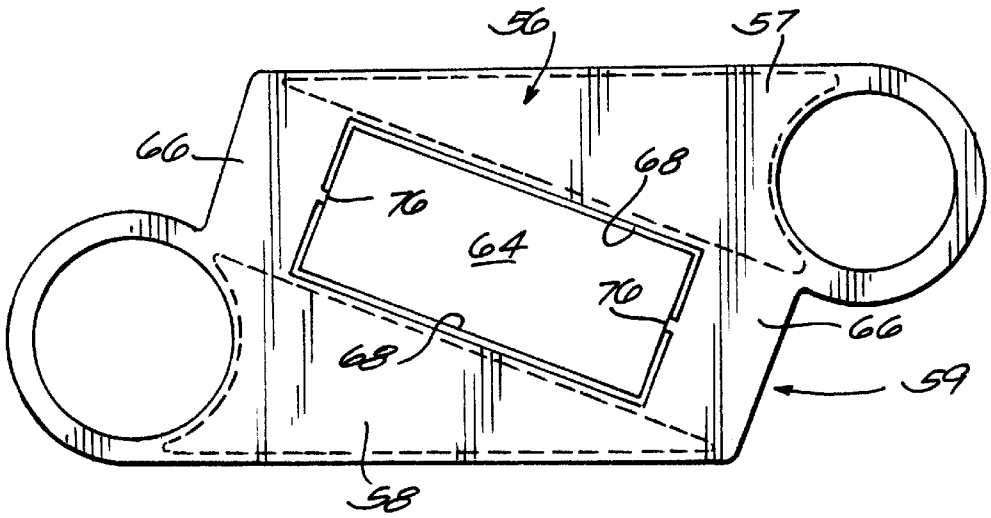
FIG. 6 is a plan view of an alternative construction of the top sheet of the core illustrated in FIG. 1.

In another embodiment, illustrated in FIG. 6, the kerf 68 may not completely surround the matrix cover 64. In such an embodiment, bridges of material 76 are left intact between the matrix cover 64 and the top sheet 56. This embodiment may improve handling of the top sheet 56 and matrix cover 64 because they are interconnected and may be handled together. Additionally, this embodiment ensures that the matrix cover 64 is centered in the window 60. Also, once the heat exchanger is set up, it should not be a problem if the bridges 76 crack or break during thermal cycles because the matrix cover 64 is sandwiched between the top frame plate 72 and the top cell 14 of the core 10.

In operation, the hot and cool portions H, C of the core 10 are subject to a substantially isothermal load, and the matrix portion M is exposed to the temperature gradient. Because the first and second ends 57, 58 of the top sheet 56 are connected only by the ligament portions 66, the middle portion 59 of the top sheet 56 is better able to accommodate the temperature gradient and the strain on and deflection of the first and second ends 57, 58 are reduced. The ligament portions 66 may therefore be referred to as compliant portions of the top sheet 56.

It should be noted that the ligament portions 66 are not necessarily drawn to scale in the drawings. It is preferably that the ligament portions 66 are longer (i. e., in the direction extending between the ends 57, 58) than wide to enhance their compliant nature. In practice the ligament portions 66 may be made longer and narrower than illustrated.

What is claimed is:

1. A heat exchanger comprising:

a core including a stacked array of plate-fin cells, said core being adapted to heat air flowing through said cells with hot gases flowing in-between said cells; and a top sheet positioned over said core and including first and second ends and a middle portion between said first and second ends, said middle portion including a window and compliant ligament portions extending alongside said window and interconnecting said first and second ends;

wherein said core includes a substantially isothermal cool portion into which the flow of air enters said cells and out of which the flow of hot gases exits said core in-between said cells, a substantially isothermal hot portion into which the flow of hot gases enters said core in-between said cells and out of which the flow of air exits said cells, and a matrix portion in-between said substantially isothermal hot and cool portions;

wherein the air and hot gases flow in counterflow relationship to each other through said matrix portion with the air flowing through said cells and the hot gases flowing in-between said cells, the majority of heat transfer between the flows of air and hot gases occurring within said matrix portion to establish a temperature gradient across said matrix portion;

wherein said first and second ends of said top sheet are positioned over said isothermal cool and hot portions of said core, respectively, and said middle portion of said top sheet is positioned over said matrix portion of said core; and wherein said compliant ligament portions of said top sheet are deflectable in response to said temperature gradient across said matrix portion of said core to reduce strain on and deflection of said first and second ends of said top sheet.

2. The heat exchanger of claim 1, further comprising a matrix cover positioned within said window.

3. The heat exchanger of claim 2, wherein a kerf is defined between said matrix cover and said top sheet.

4. The heat exchanger of claim 3, further comprising a top frame plate positioned over said top sheet such that said top sheet is sandwiched between said top frame plate and said core to resist fluid flow through said kerf.

5. The heat exchanger of claim 3, wherein said kerf surrounds the entire perimeter of said matrix cover except for at least one bridge of material joining said matrix cover with at least one of said ligament portions.

6. The heat exchanger of claim 2, wherein said matrix cover includes a portion of said top sheet cut from and completely removable from said middle portion of said top sheet.

7. The heat exchanger of claim 1, wherein each cell includes an external finned member affixed to an outer surface of said cell, wherein said top sheet is positioned over the external finned member of the top cell of said core to define a hot fluid flow region therebetween to accommodate the flow of hot gases, and wherein said window is positioned over said external finned member.

8. The heat exchanger of claim 7, wherein said external finned member is larger than said window in at least one dimension to prevent said external finned member from extending through said window.

* * * * *